US011359269B2

(12) United States Patent
Morales et al.

(10) Patent No.: US 11,359,269 B2
(45) Date of Patent: Jun. 14, 2022

(54) HIGH STRENGTH DUCTILE 6000 SERIES ALUMINUM ALLOY EXTRUSIONS

(71) Applicant: GM GLOBAL TECHNOLOGY OPERATIONS LLC, Detroit, MI (US)

(72) Inventors: Arianna T. Morales, Bloomfield Hills, MI (US); Raja K. Mishra, Shelby Township, MI (US); Anil K. Sachdev, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 230 days.

(21) Appl. No.: 16/271,239

(22) Filed: Feb. 8, 2019

(65) Prior Publication Data

US 2020/0255928 A1 Aug. 13, 2020

(51) Int. Cl.
*C22F 1/05* (2006.01)
*C22C 21/08* (2006.01)

(52) U.S. Cl.
CPC ..... *C22F 1/05* (2013.01); *C22C 21/08* (2013.01)

(58) Field of Classification Search
CPC ..... C22F 1/05; C22C 21/08
See application file for complete search history.

(56) References Cited

U.S. PATENT DOCUMENTS 3,717,512 A * 2/1973 Sperry ..... C22C 21/00 148/439
4,231,817 A * 11/1980 Takeuchi ..... C22C 21/10 148/439
4,526,630 A * 7/1985 Field ..... C22F 1/057 148/700
5,948,185 A 9/1999 Krajewski et al.
6,045,636 A 4/2000 Krajewski
6,811,625 B2 11/2004 Verma
7,216,927 B2 5/2007 Luo et al.
(Continued)

FOREIGN PATENT DOCUMENTS

CN 103045919 A 4/2013
CN 104152758 A 11/2014
(Continued)

OTHER PUBLICATIONS

First Office Action in Chinese Patent Application No. 202010082539.1 dated Mar. 31, 2021 with correspondence dated Apr. 2, 2021 from China Patent Agent (H.K.) Ltd. summarizing contents, 8 pages.

*Primary Examiner* — Anthony J Zimmer
*Assistant Examiner* — Ricardo D Morales
(74) *Attorney, Agent, or Firm* — Harness, Dickey & Pierce, P.L.C.

(57) ABSTRACT

An alloy composition is provided. The alloy composition includes silicon (Si) at a concentration of greater than or equal to about 0.55 wt. % to less than or equal to about 0.75 wt. %, magnesium (Mg) at a concentration of greater than or equal to about 0.55 wt. % to less than or equal to about 0.75 wt. %, chromium (Cr) at a concentration of greater than or equal to about 0.15 wt. % to less than or equal to about 0.3 wt. %, and a balance of the alloy composition being aluminum (Al). The alloy composition has an intermetallic phase content of less than or equal to about 3 wt. %. Methods of preparing the alloy composition and of processing the alloy composition are also provided.

6 Claims, 2 Drawing Sheets

(56) References Cited

U.S. PATENT DOCUMENTS

| | | | |
|---|---|---|---|
| 7,967,928 | B2 | 6/2011 | Luo et al. |
| 8,163,113 | B2 | 4/2012 | Mishra et al. |
| 8,287,966 | B2 | 10/2012 | Sundarraj et al. |
| 8,327,910 | B2 | 12/2012 | Walker et al. |
| 8,361,251 | B2 | 1/2013 | Luo et al. |
| 8,708,425 | B2 | 4/2014 | Carlson et al. |
| 8,889,226 | B2 | 11/2014 | Walker et al. |
| 8,992,696 | B2 | 3/2015 | Walker et al. |
| 9,358,608 | B2 | 6/2016 | Carlson et al. |
| 9,481,034 | B2 | 11/2016 | Chen et al. |
| 9,593,396 | B2 | 3/2017 | Luo et al. |
| 9,771,635 | B2 | 9/2017 | Wang et al. |
| 9,840,761 | B2 | 12/2017 | Tundal et al. |
| 10,815,552 | B2 | 10/2020 | Parson et al. |
| 2008/0096039 | A1 | 4/2008 | Sachdev et al. |
| 2009/0071620 | A1 | 3/2009 | Bharadwaj et al. |
| 2011/0286880 | A1 | 11/2011 | Luo et al. |
| 2012/0273539 | A1 | 11/2012 | Carter |
| 2016/0355914 | A1 | 12/2016 | Takemura |
| 2017/0009322 | A1 | 1/2017 | Tundal et al. |
| 2018/0171449 | A1 | 6/2018 | Skubich et al. |

FOREIGN PATENT DOCUMENTS

| | | | |
|---|---|---|---|
| CN | 104245981 | A | 12/2014 |
| CN | 105264102 | A | 1/2016 |
| CN | 105296811 | A | 2/2016 |
| CN | 107326227 | A | 11/2017 |
| CN | 111549260 | A | 8/2020 |
| DE | 102010055444 | A1 | 6/2012 |
| DE | 102020100994 | A1 | 8/2020 |
| WO | 2016129127 | A1 | 8/2016 |

* cited by examiner

HIGH STRENGTH DUCTILE 6000 SERIES ALUMINUM ALLOY EXTRUSIONS

INTRODUCTION

This section provides background information related to the present disclosure which is not necessarily prior art.

Components made of aluminum alloys have become ever more prevalent in various industries and applications, including general manufacturing, construction equipment, automotive or other transportation industries, home or industrial structures, aerospace, and the like. For example, aluminum alloys are used in manufacturing industries for extruding parts having uniform cross-sectional geometries or made from parts having uniform cross-sectional geometries. In particular, 7000 series aluminum alloys (aluminum alloys with zinc) have a high strength and are lower in weight than steel, which results in decreased fuel consumption. In contrast, 6000 series aluminum alloys (aluminum alloys with magnesium and silicon) are easier to process, but are too weak for many of the applications 7000 series alloys are used for. Therefore, it is desirable to develop a 6000 series alloy that has the strength properties of a 7000 series alloy.

SUMMARY

This section provides a general summary of the disclosure, and is not a comprehensive disclosure of its full scope or all of its features.

The present disclosure relates to high strength ductile 6000 alloy extrusions.

In various aspects, the current technology provides an alloy composition including silicon (Si) at a concentration of greater than or equal to about 0.55 wt. % to less than or equal to about 0.75 wt. %; magnesium (Mg) at a concentration of greater than or equal to about 0.55 wt. % to less than or equal to about 0.75 wt. %; chromium (Cr) at a concentration of greater than or equal to about 0.15 wt. % to less than or equal to about 0.3 wt. %; and a balance of the alloy composition being aluminum (Al), wherein the alloy composition has an intermetallic phase content of less than or equal to about 3 wt. %.

In one aspect, the Si and the Mg are present at a Si:Mg ratio of greater than or equal to about 0.9 (9:10) to less than or equal to about 1.1 (11:10).

In one aspect, the alloy composition further includes at least one of iron (Fe) at a concentration of greater than or equal to about 0.15 wt. % to less than or equal to about 0.25 wt. %; copper (Cu) at a concentration of greater than about 0 wt. % to less than or equal to about 0.3 wt. %; manganese (Mn) at a concentration of greater than or equal to about 0.3 wt. % to less than or equal to about 0.5 wt. %; and zinc (Zn) at a concentration of greater than or equal to about 0.1 wt. % to less than or equal to about 0.2 wt. %.

In one aspect, the alloy composition includes each of the Fe, Cu, Mn, and Zn.

In one aspect, the alloy composition is substantially free of titanium (Ti).

In one aspect, the alloy composition is configured to have a bamboo grain crystal structure after processing, wherein the bamboo grain crystal structure includes greater than or equal to about 80% aligned longitudinal grains.

In one aspect, the alloy composition is configured to have a tensile strength of greater than or equal to about 280 MPa after processing.

In one aspect, the alloy composition is in the form of a billet.

In one aspect, an automobile part includes the alloy composition.

In various aspects, the current technology also provides a method of fabricating an extruded object, the method including: heating an alloy composition to a temperature of greater than or equal to about 400° C. to less than or equal to about 650° C. to form a heated alloy composition; extruding the heated alloy composition through a die to form a heated extruded part; quenching the heated extruded part to form a cooled extruded part; and tempering the cooled extruded part to form the extruded object, wherein the alloy composition includes silicon (Si) at a concentration of greater than or equal to about 0.55 wt. % to less than or equal to about 0.75 wt. %; magnesium (Mg) at a concentration of greater than or equal to about 0.55 wt. % to less than or equal to about 0.75 wt. %; chromium (Cr) at a concentration of greater than or equal to about 0.15 wt. % to less than or equal to about 0.3 wt. %; and a balance of the alloy composition being aluminum (Al), wherein the alloy composition has an intermetallic phase content of less than or equal to about 3 wt. %.

In one aspect, the extruding is performed with a ram pressure of greater than or equal to about 2500 psi to less than or equal to about 5000 psi and with an extrusion speed of greater than or equal to about 2 ipm to less than or equal to about 10 ipm.

In one aspect, the quenching is performed by water mist at a cooling rate of greater than or equal to about 300° C./min to less than or equal to about 1200° C./min.

In one aspect, the tempering includes aging the cooled extruded part at a temperature of greater than or equal to about 150° C. to less than or equal to about 250° C. for a time of greater than or equal to about 1 hour to less than or equal to about 5 hours.

In one aspect, the extruded object has a bamboo grain crystal structure including greater than or equal to about 80% aligned longitudinal grains.

In one aspect, the extruded object is an automobile part selected from the group consisting of a rocker, a control arm, a rail, a beam, a reinforcement panel, a bumper, a step, a subframe member, and a pillar.

In one aspect, prior to the heating, the alloy composition was subjected to a homogenization process including heating the alloy composition at a first rate of greater than or equal to about 6° C./min to less than or equal to about 10° C./min until the alloy composition reaches a first temperature of greater than or equal to about 450° C. to less than or equal to about 550° C.; maintaining the alloy composition at the first temperature for greater than or equal to about 30 minutes to less than or equal to about 2 hours; heating the alloy composition at a second rate of greater than or equal to about 0.1° C./min to less than or equal to about 1° C./min until the alloy composition reaches a second temperature of greater than or equal to about 550° C. to less than or equal to about 600° C.; maintaining the alloy composition at the second temperature for greater than or equal to about 1 hour to less than or equal to about 5 hours; and quenching the alloy composition.

In various aspects, the current technology yet further provides a method of producing an alloy composition, the method including combining alloy components to form a mixture, the alloy components including silicon (Si) at a concentration of greater than or equal to about 0.55 wt. % to less than or equal to about 0.75 wt. %, magnesium (Mg) at a concentration of greater than or equal to about 0.55 wt. % to less than or equal to about 0.75 wt. %, chromium (Cr) at a concentration of greater than or equal to about 0.15 wt. % to less than or equal to about 0.3 wt. %, and a balance of aluminum (Al); melting the mixture to form an alloy solution; casting the alloy solution into a billet; and subjecting the billet to a homogenization process including heating the billet at a first rate of greater than or equal to about 6° C./min to less than or equal to about 10° C./min until the billet reaches a first temperature of greater than or equal to about 450° C. to less than or equal to about 550° C.; maintaining the billet at the first temperature for greater than or equal to about 30 minutes to less than or equal to about 2 hours; heating the billet at a second rate of greater than or equal to about 0.1° C./min to less than or equal to about 1° C./min until the billet reaches a second temperature of greater than or equal to about 550° C. to less than or equal to about 600° C.; maintaining the billet at the second temperature for greater than or equal to about 1 hour to less than or equal to about 5 hours; and quenching the billet to form the alloy composition.

In one aspect, the Si and the Mg are present in the mixture at a Si:Mg ratio of greater than or equal to about 0.9 (9:10) to less than or equal to about 1.1 (11:10).

In one aspect, the alloy components further include at least one of iron (Fe) at a concentration of greater than or equal to about 0.15 wt. % to less than or equal to about 0.25 wt. %, copper (Cu) at a concentration of greater than about 0 wt. % to less than or equal to about 0.3 wt. %, manganese (Mn) at a concentration of greater than or equal to about 0.3 wt. % to less than or equal to about 0.5 wt. %, and zinc (Zn) at a concentration of greater than or equal to about 0.1 wt. % to less than or equal to about 0.2 wt. %.

In one aspect, the alloy composition has an intermetallic phase content of less than or equal to about 3 wt. %.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
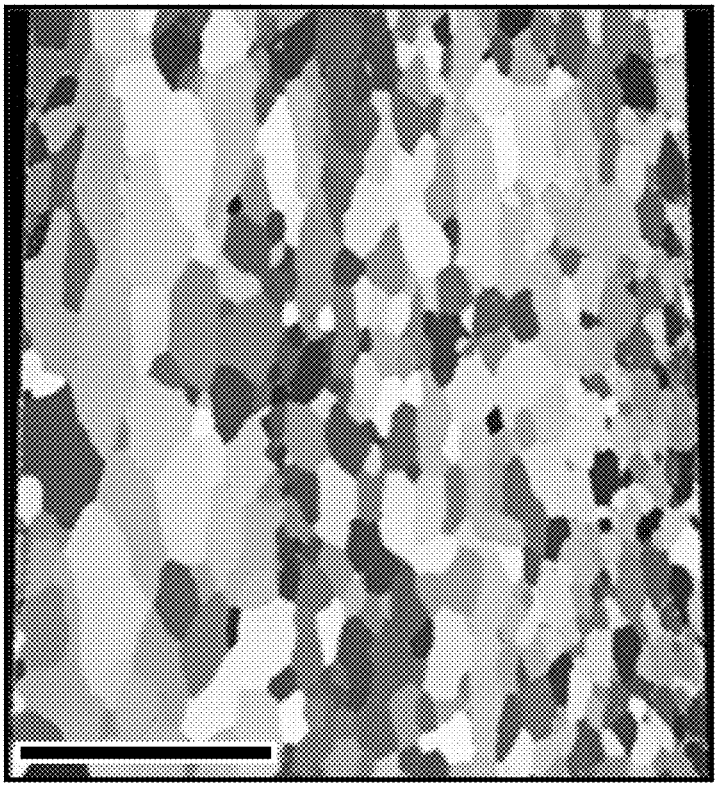
FIG. 1 is an electron backscatter diffraction (EBSD) image showing the microstructure of an alloy composition that is not in accordance with the current technology. The scale bar is 700 am.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

6000 series alloys are less expensive and easier to process relative to 7000 series alloys. However, 6000 series are not as strong as 7000 series alloys. Accordingly, the current technology provides an alloy composition that is a 6000 series alloy, a method of preparing the alloy composition, and a method of processing the alloy composition.

The current technology provides a method of producing an alloy composition, which is a 6000 series alloy. The method comprises combining alloy components to form a mixture. The alloy components comprise silicon (Si) at a concentration of greater than or equal to about 0.55 wt. % to less than or equal to about 0.75 wt. % or greater than or equal to about 0.6 wt. % to less than or equal to about 0.7 wt. %, magnesium (Mg) at a concentration of greater than or equal to about 0.55 wt. % to less than or equal to about 0.75 wt. % or greater than or equal to about 0.6 wt. % to less than or equal to about 0.7 wt. %, chromium (Cr) at a concentration of greater than or equal to about 0.1 wt. % to less than or equal to about 0.3 wt. % or greater than or equal to about 0.2 wt. % to less than or equal to about 0.2.5 wt. %, and a balance of aluminum (Al).

The Si and Mg are present in the mixture at substantially equivalent concentrations. As used herein, a "substantially equivalent" concentration of Si and Mg means that the Si and Mg are present in the mixture at a Si:Mg ratio of greater than or equal to about 0.9 (9:10) to less than or equal to about 1.1 (11:10), greater than or equal to about 0.95 (19:20) to less than or equal to about 1.05 (21:20), or greater than or equal to about 0.98 (49:50) to less than or equal to about 1.02 (51:50).

In various aspects of the current technology, the alloy components further comprise at least one of iron (Fe) at a concentration of greater than or equal to about 0.15 wt. % to less than or equal to about 0.25 wt. %, copper (Cu) at a concentration of greater than about 0 wt. % to less than or equal to about 0.3 wt. %, manganese (Mn) at a concentration of greater than or equal to about 0.3 wt. % to less than or equal to about 0.5 wt. % or greater than or equal to about 0.35 wt. % to less than or equal to about 0.45 wt. %, and zinc (Zn) at a concentration of greater than or equal to about 0.05 wt. % to less than or equal to about 0.15 wt. %. In some aspects of the current technology, the alloy components further comprise each of the Fe, Cu, Mn, and Zn.

The alloy components are substantially free of titanium (Ti). By "substantially free" of Ti, it is meant that the alloy components comprise less than or equal to about 0.1 wt. % Ti or less than or equal to about 0.05 wt. % Ti.

Therefore, the alloy components comprise the Si, Mg, Cr, and Al, and optionally include at least one of the Fe, Cu, Mn, and Zn. However, it is understood that the alloy components can include trace levels of contaminants, i.e., other unintended elements or small molecules. As used herein, "trace levels" includes levels of greater than or equal to 0 wt. % to less than or equal to about 0.1 wt. % or greater than 0 wt. % to less than or equal to about 0.05 wt. % for each unintended contaminant. Therefore, in some aspects of the current technology, the alloy components consist essentially of the Si, Mg, Cr, and Al, and at least one of the Fe, Cu, Mn, and Zn. Therefore, by "consist essentially of" it is meant that the alloy components can also include trace amounts of contaminants. In other aspects of the current technology, the alloy components consist essentially of the Si, Mg, Cr, Fe, Cu, Mn, Zn, and Al. In some embodiments, the alloy components comprise, consist essentially of, or consist of greater than or equal to about 0.6 wt. % to less than or equal to about 0.7 wt. % of the Si, greater than or equal to about 0.6 wt. % to less than or equal to about 0.7 wt. % of the Mg, about 0.2 wt. % of the Fe, less than or equal to about 0.3 wt. % of the Cu, about 0.4 wt. % of the Mn, greater than or equal to about 0.2 wt. % to less than or equal to about 0.25 wt. % of the Cr, about 0.1 wt. % of the Zn, and a balance of the Al.

The method also includes melting the mixture to form an alloy solution and casting the alloy solution into a billet, i.e., a cylindrical shape. A temperature of greater than or equal to about 500° C. to less than or equal to about 700° C., or greater than or equal to about 560° C. to less than or equal to about 660° C. is generally suitable for the melting. However, it is understood that a temperature outside of this range may be necessary depending on the elements used. The billet or sheet is then subjected to a two-step homogenization process. The two-step homogenization process comprises a first step of heating the billet from ambient temperature at a first rate of greater than or equal to about 6° C./min to less than or equal to about 10° C./min until the billet reaches a first temperature of greater than or equal to about 450° C. to less than or equal to about 550° C. or greater than or equal to about 475° C. to less than or equal to about 525° C. and maintaining the billet at the first temperature for greater than or equal to about 30 minutes to less than or equal to about 2 hours or from greater than or equal to about 45 minutes to less than or equal to about 1.5 hours. The two-step homogenization process also comprises a second step of heating the billet at a second rate of greater than or equal to about 0.1° C./min to less than or equal to about 1° C./min until the billet reaches a second temperature of greater than or equal to about 550° C. to less than or equal to about 600° C. and maintaining the billet at the second temperature for greater than or equal to about 1 hour to less than or equal to about 5 hours or greater than or equal to about 2 hours to less than or equal to about 3 hours. Finally, the two-step homogenization process comprises quenching the billet, such as, for example, by forced air, to ambient temperature to form the alloy composition. The quenching is performed in a quench medium selected from the group consisting of still water, still oil, molten salt, fluidized bed, moving air, moving hot air, still air, and combinations thereof, as non-limiting examples at a rate of greater than or equal to about 1° C./sec to less than or equal to about 250° C./second, depending on the quench medium. As non-limiting examples, a quench medium of still water can be used at a rate of about 240° C./sec, a quench medium of still oil can be used at a rate of about 34° C./sec, a quench medium of molten salt can be used at a rate of about 19° C./sec, a quench medium of a fluidized bed can be used at a rate of about 9.6° C./sec, a quench medium of moving air can be used at a rate of about 40° C./sec, a quench medium of moving hot air can be used at a rate of about 3.4° C./sec, and a quench medium of still air can be used at a rate of about 1.4° C./sec.

In an exemplary embodiment, the two-step homogenization comprises heating the billet from ambient temperature to a first temperature of about 520° C. over a time period of about 1 hour, maintaining the billet or sheet at the 520° C. for about 1 hour, heating the billet at a rate of about 0.5° C./minute from the 520° C. to a second temperature of about 585° C., maintaining the billet at the 585° C. for about 2 hours, and quenching the billet by forced air to ambient temperature to form the alloy composition.

During the two-step homogenization process, large intermetallic particles and inclusions can form after the casting are dissolved and a saturated solid solution is created. Precipitation of the intermetallic particles and inclusions is controllable by adjusting the temperatures, times, and cooling rates employed during the homogenization process. For example, 6000 series alloys are subjected to a one-step heat treatment that comprises heating a 6000 series alloy for 1 hour, heating at a temperature of from 560° C. to 570° C. for 6 hours, and then quenching. When a comparative alloy composition comprising Si, Mg, Fe, Cu, Mn, Zn, and Al at the above levels, but which does not include Cr, is subjected to this one-step process, the comparative alloy composition comprises about 5 wt. % intermetallic phases. In contrast, when the alloy composition of the current technology, comprising the same components as the comparative alloy composition, but also including Cr, is subjected to the two-step homogenization process, the resulting alloy composition comprises only about 1 wt. % intermetallic phases. Accordingly, the alloy composition made from the current method has an intermetallic phase content of less than or equal to about 3 wt. %, less than or equal to about 2.5 wt. %, less than or equal to about 2 wt. %, or less than or equal to about 1.5 wt. %. The intermetallic phase is dependent on the components of the alloy composition, but in various embodiments includes at least one of $Mg_2Si$, and $\alpha$-$Al_{15}(FeMn)_3Si$.

The current technology also provides an alloy composition, i.e., a 6000 series alloy composition, that can be produced by the above method. The alloy composition comprises silicon (Si) at a concentration of greater than or equal to about 0.55 wt. % to less than or equal to about 0.75 wt. % or greater than or equal to about 0.6 wt. % to less than or equal to about 0.7 wt. %, magnesium (Mg) at a concentration of greater than or equal to about 0.55 wt. % to less than or equal to about 0.75 wt. % or greater than or equal to about 0.6 wt. % to less than or equal to about 0.7 wt. %, chromium (Cr) at a concentration of greater than or equal to about 0.1 wt. % to less than or equal to about 0.3 wt. % or greater than or equal to about 0.2 wt. % to less than or equal to about 0.2.5 wt. %, and a balance of aluminum (Al).

The Si and Mg are present in the alloy composition at substantially equivalent concentrations, such as at a Si:Mg ratio of greater than or equal to about 0.9 (9:10) to less than or equal to about 1.1 (11:10), greater than or equal to about 0.95 (19:20) to less than or equal to about 1.05 (21:20), or greater than or equal to about 0.98 (49:50) to less than or equal to about 1.02 (51:50).

In various aspects of the current technology, the alloy composition further comprises at least one of iron (Fe) at a concentration of greater than or equal to about 0.10 wt. % to less than or equal to about 0.25 wt. %, copper (Cu) at a concentration of greater than about 0 wt. % to less than or equal to about 0.3 wt. %, manganese (Mn) at a concentration of greater than or equal to about 0.3 wt. % to less than or equal to about 0.5 wt. % or greater than or equal to about 0.35 wt. % to less than or equal to about 0.45 wt. %, and zinc (Zn) at a concentration of greater than or equal to about 0.05 wt. % to less than or equal to about 0.15 wt. %. In some aspects of the current technology, the alloy composition further comprises each of the Fe, Cu, Mn, and Zn.

The alloy composition is substantially free of titanium (Ti). By "substantially free" of Ti, it is meant that the alloy composition comprises less than or equal to about 0.1 wt. % Ti or less than or equal to about 0.05 wt. % Ti.

Therefore, the alloy composition comprises the Si, Mg, Cr, and Al, and optionally includes at least one of the Fe, Cu, Mn, and Zn. However, it is understood that the alloy composition can include trace levels of contaminants, i.e., other unintended elements or small molecules. As used herein, "trace levels" includes levels of greater than or equal to 0 wt. % to less than or equal to about 0.1 wt. % or greater than 0 wt. % to less than or equal to about 0.05 wt. % for each unintended contaminant. Therefore, in some aspects of the current technology, the alloy composition consists essentially of the Si, Mg, Cr, and Al and at least one of the Fe, Cu, Mn, and Zn. Therefore, by "consists essentially of" it is meant that the alloy composition can also include trace amounts of contaminants. In other aspects of the current technology, the alloy composition consists essentially of the Si, Mg, Cr, Fe, Cu, Mn, Zn, and Al. In some embodiments, the alloy composition comprises, consists essentially of, or consists of greater than or equal to about 0.6 wt. % to less than or equal to about 0.7 wt. % of the Si, greater than or equal to about 0.6 wt. % to less than or equal to about 0.7 wt. % of the Mg, about 0.2 wt. % of the Fe, less than or equal to about 0.3 wt. % of the Cu, about 0.4 wt. % of the Mn, greater than or equal to about 0.2 wt. % to less than or equal to about 0.25 wt. % of the Cr, about 0.1 wt. % of the Zn, and a balance of the Al.

Figure 2A:
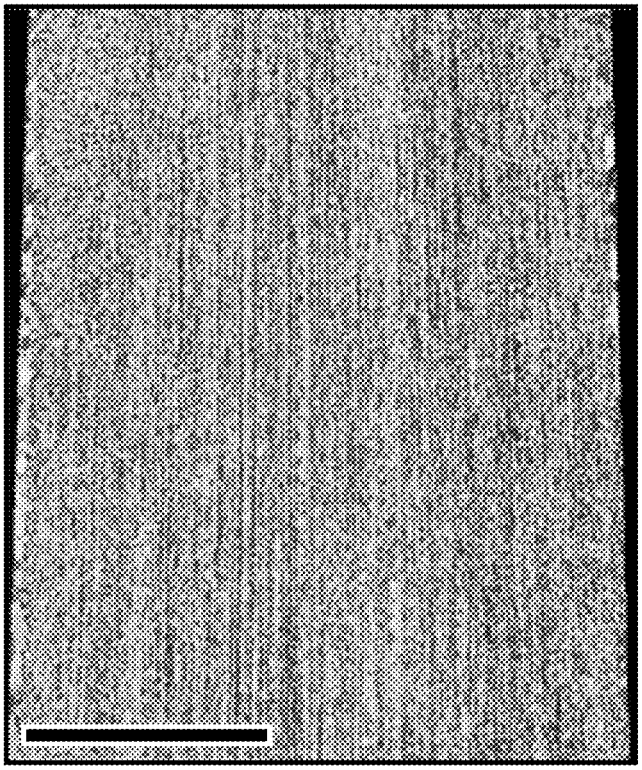
FIG. 2A is an electron backscatter diffraction (EBSD) image showing the microstructure of an alloy composition that is in accordance with various aspects of the current technology. The scale bar is 700 am.
Figure 2B:
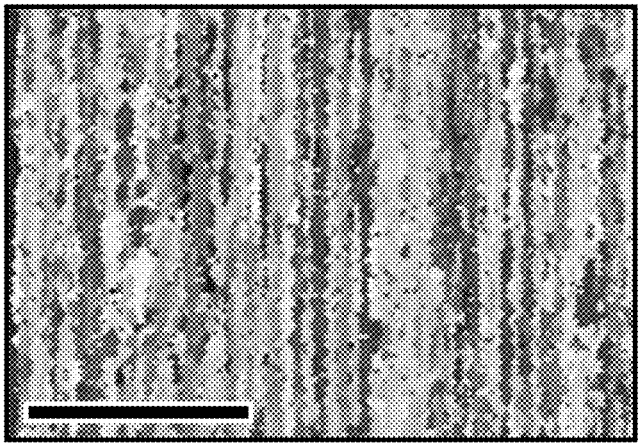
FIG. 2B is an expanded view of a portion of the EBSD image shown in FIG. 2A. The scale bar is 100 am.

The alloy composition can be in the form of a billet. As a billet, the alloy composition is suitable to undergo an extrusion process that provides the alloy composition with a microstructure that is different from a microstructure of a comparable alloy composition. For example, when the comparative alloy composition described above is processed according to a method used for 6000 series alloys, a microstructure shown in FIG. 1 is obtained. Here, an electron backscatter diffraction (EBSD) image shows an initial microstructure defined by fibers that are overcome by grain growth. Therefore, the microstructure is globular, uniform, unordered, and random. As a result, the comparative alloy composition is subject to fracture in all directions. In contrast, FIGS. 2A and 2B show EBSD images of the alloy composition of the current technology after processing, which is described in further detail below. These images show that the processed alloy composition is configured to have a fibrous "bamboo-like" microstructure that is not overcome by grain growth after processing. This bamboo grain crystal structure comprises greater than or equal to about 70%, greater than or equal to about 75%, greater than or equal to about 80%, greater than or equal to about 85%, or greater than or equal to about 90% longitudinal non-globular grains that are highly uniform, highly ordered, and aligned. Grain size and orientation are obtainable by EBSD.

In a reference (longitudinal) direction, greater than or equal to about 50%, greater than or equal to about 60%, or greater than or equal to about 70% of the grains have a crystallographic orientation of less than or equal to about 15°, or less than or equal to about 10° to each other. In a direction transverse to the reference direction, greater than or equal to about 50%, greater than or equal to about 60%, or greater than or equal to about 70% of the grains have a crystallographic orientation of greater than or equal to about 15°, or greater than or equal to about 20° relative to each other and relative to the reference direction. The bamboo grain crystal structure provides high strength in both longitudinal (along the grains) and transverse (perpendicular to the grains) directions that are comparable to 7000 series alloys. Accordingly, the alloy composition is configured to have a tensile strength of at least about 280 MPa, at least about 300 MPa, or at least about 350 MPa, such as a tensile strength of greater than or equal to about 280 MPa to less than or equal to about 700 MPa or higher.

With strengths comparable to 7000 series alloys, the alloy composition can be processed into an extruded object, such as, for example, a vehicle part or other 6000 alloy extrusion. Non-limiting examples of vehicles that have parts suitable to be produced with the alloy composition include automobiles, motorcycles, bicycles, boats, tractors, buses, mobile homes, campers, gliders, airplanes, and military vehicles, such as tanks. In various aspects of the current technology, the extruded object is an automobile part selected from the group consisting of a rocker, a control arm, a rail, a beam, a reinforcement panel, a bumper, a step, a subframe member, and a pillar. Therefore, the current technology also provides an automobile part, or other extruded object, comprising the alloy composition.

Accordingly, the current technology yet further provides a method of fabricating an extruded object by processing the alloy composition. More particularly, the method comprises heating the alloy composition to a temperature of greater than or equal to about 400° C. to less than or equal to about 650° C., greater than or equal to about 450° C. to less than or equal to about 600° C., or greater than or equal to about 510° C. to less than or equal to about 540° C., to form a heated alloy composition. The heating can be performed, for example, by heating the alloy composition in the form of a billet in a furnace.

After the heating, the method comprises extruding the heated alloy composition through a die to form a heated extruded part. The die comprises a slit that matches a cross-sectional geometry of the object being made. As such, the heated extruded part has a uniform cross-sectional geometry that is defined by the die.

The extruding is performed by pushing the alloy composition through the die with a ram using a ram pressure of greater than or equal to about 2500 psi to less than or equal to about 5000 psi, greater than or equal to about 3000 psi to less than or equal to about 4500 psi, greater than or equal to about 3100 psi to less than or equal to about 4200 psi, greater than or equal to about 3200 psi to less than or equal to about 4000 psi, and with an extrusion speed of greater than or equal to about 2 inches/min (ipm) to less than or equal to about 10 ipm, greater than or equal to about 3 ipm to less than or equal to about 9 ipm, or greater than or equal to about 4 ipm to less than or equal to about 8 ipm.

Next, the method comprises quenching the heated extruded part to form a cooled extruded part. The quenching is performed at a rate fast enough to avoid formation of undesirable precipitates, but not too fast such that cracks or distortions are generated. Therefore, the quenching comprises lowering the temperature of the heated extruded part to ambient temperature at a rate of greater than or equal to about 300° C./min (about 573.15 K/min) to less than or equal to about 1200° C./min (about 1473.15 K/min), greater than or equal to about 400° C./min (about 673.15 K/min) to less than or equal to about 1100° C./min (about 1373.15 K/min), greater than or equal to about 500° C./min (about 773.15 K/min) to less than or equal to about 1000° C./min (about 1273.15 K/min), or greater than or equal to about 526.85° C./min (about 800 K/min) to less than or equal to about 926.85° C./min (about 1200 K/min). The quenching is performed by any method that is capable of cooling at the above rates, such as by contacting the heated extruded part with water or cold water mist.

The method then comprises tempering the cooled extruded part to form the extruded object. The tempering comprises aging the cooled extruded object at a temperature of greater than or equal to about 150° C. to less than or equal to about 250° C., greater than or equal to about 175° C. to less than or equal to about 215° C., or greater than or equal to about 180° C. to less than or equal to about 200° C., such as at a temperature of about 150° C., about 155° C., about 160° C., about 165° C., about 170° C., about 175° C., about 180° C., about 185° C., about 190° C., about 195° C., about 200° C., about 205° C., about 210° C., about 215° C., about 220° C., about 225° C., about 230° C., about 235° C., about 240° C., about 245° C., or about 255° C. The aging is performed for a time of greater than or equal to about 1 hour to less than or equal to about 5 hours or greater than or equal to about 2 hours to less than or equal to about 4 hours, such as for about 1 hour, about 1.5 hours, about 2 hours, about 2.5 hours, about 3 hours, about 3.5 hours, about 4 hours, about 4.5 hours, or about 5 hours.

In various aspects of the current technology, the method also includes at least one of stretching the cooled extruded part to improve the straightness of the cooled extruded part prior to the tempering; discarding a portion from each end of the cooled extruded part or the extruded object prior to or after the tempering because the cooled extruded part or extruded object, whichever the case may be, has a discard length of less than or equal to about 5 inches, less than or equal to about 2.5 inches, or less than or equal to about 1 inch; cutting the cooled extruded part or the extruded object to a desired size (for example, it is envisioned that a plurality of objects can be cut to form a length of the extruded object); etching the extruded object; anodizing the extruded object; and further processing the extruded object, such as by bending or denting into a desired shape.

The extruded object has the bamboo grain crystal structure described above and shown in FIGS. 2A-2B. In contrast, when the comparable alloy composition is processed by extruding with a billet temperature of from 482° C. to 532° C., a ram pressure of 2400 psi to 3100 psi, and an extrusion speed of 5 ipm to 12 ipm and tempering at 172° C. for 10 hours, the microstructure shown in FIG. 1 is obtained. Without being bound by theory, it is believed that the Cr and Mn of the current alloy composition precipitate as fine incoherent particles that control grain size, which enables retention of fully recrystallized and "bamboo-type" grain structure. By putting a maximum amount of solute in solution, age hardening capacity is maximized. Moreover, some Cr remains in the solution and improves the plasticity of the processed alloy composition relative to the processed comparable alloy composition. Therefore, the two-step homogenization and tempering processes provided by the current technology removes large intermetallic particles, which are otherwise premature fracture initiation sites, and instead puts solutes in solution for strength.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An alloy composition consisting essentially of:

silicon (Si) at a concentration of greater than or equal to about 0.55 wt. % to less than or equal to about 0.75 wt. %;

magnesium (Mg) at a concentration of greater than or equal to about 0.55 wt. % to less than or equal to about 0.75 wt. %;

chromium (Cr) at a concentration of greater than or equal to about 0.15 wt. % to less than or equal to about 0.3 wt. %;

optionally iron (Fe) at a concentration of less than or equal to about 0.25 wt. %;

optionally copper (Cu) at a concentration of less than or equal to about 0.3 wt. %;

optionally manganese (Mn) at a concentration of less than or equal to about 0.5 wt. %; and optionally zinc (Zn) at a concentration of less than or equal to about 0.2 wt. %;

optionally trace contaminants each present at less than or equal to 0.05 wt. %, and a balance of the alloy composition being aluminum (Al), wherein the Si and Mg are present in the alloy composition at a Si:Mg ratio of greater than or equal to about 0.95 (19:20) to less than or equal to about 1.05 (21:20); and wherein the alloy composition has an intermetallic phase content of less than or equal to about 3 wt. % and a tensile strength of greater than or equal to about 350 MPa after processing.

2. The alloy composition according to claim 1, comprising at least one of iron (Fe) at a concentration of greater than or equal to about 0.15 wt. % to less than or equal to about 0.25 wt. %;

copper (Cu) at a concentration of greater than about 0 wt. % to less than or equal to about 0.3 wt. %;

manganese (Mn) at a concentration of greater than or equal to about 0.3 wt. % to less than or equal to about 0.5 wt. %; and zinc (Zn) at a concentration of greater than or equal to about 0.1 wt. % to less than or equal to about 0.2 wt. %.

3. The alloy composition according to claim 2, comprising each of the Fe, Cu, Mn, and Zn.

4. The alloy composition according to claim 1, wherein the alloy composition is configured to have a bamboo grain crystal structure after processing, wherein the bamboo grain crystal structure comprises greater than or equal to about 80% aligned longitudinal grains.

5. The alloy composition according to claim 1, wherein the alloy composition is in the form of a billet.

6. An automobile part comprising the alloy composition according to claim 1.

* * * * *